United States Patent [19]

Morianz et al.

[11] Patent Number: 4,751,422

[45] Date of Patent: Jun. 14, 1988

[54] TUBULAR ELECTRIC INCANDESCENT LAMP

[75] Inventors: Kurt Morianz, Wellington, New Zealand; Franz Rendl; Peter Wancura, both of Gmunden, Austria

[73] Assignee: U.S. Philips Corporation, New York, N.Y.

[21] Appl. No.: 942,658

[22] Filed: Dec. 17, 1986

[30] Foreign Application Priority Data

Mar. 18, 1986 [NL] Netherlands ..... 8600683

[51] Int. Cl.[4] ..... H01K 7/00

[52] U.S. Cl. ..... 313/318; 313/315; 439/612; 439/280; 439/226; 439/871; 439/830

[58] Field of Search ..... 313/318, 315, 331; 339/50 R, 56, 59 R, 59 L, 61 R, 61 L, 144 R, 145 R, 145 D, 176 L, 255 R, 256 R, 258 R, 278 L

[56] References Cited

U.S. PATENT DOCUMENTS 3,555,342 1/1971 McFall ..... 313/318

3,999,095 12/1976 Pearce, Jr. et al. ..... 313/318

4,069,437 1/1978 Notelteirs et al. ..... 313/315

4,404,491 9/1983 Siaens et al. ..... 313/318

*Primary Examiner*—Leo H. Boudreau

*Assistant Examiner*—Mark R. Powell

*Attorney, Agent, or Firm*—Emmanuel J. Lobato

[57] ABSTRACT

The tubular electric incandescent lamp has at its ends (7,8) metal hoods (4), to which the current supply conductors (9,10) are secured. The metal hoods (4) are arranged in an insulator housing (5,6) provided with an opening (13), through which a contact member (11,12) extends to the exterior. The contact member (11,12) has a bifurcate part (19) which grips around the metal hood (4) behind a collar (17) at the said hood. The insulator housings (5,6) lock the contact members (11,12) against radial displacement. By the collar (17) and the insulator housing (6), the contact member (12) is undetachably connected to the metal hood (4). The lamp can be constructed so that the contact members (11,12) are displaceable in longitudinal direction between two extreme positions.

12 Claims, 1 Drawing Sheet

TUBULAR ELECTRIC INCANDESCENT LAMP

BACKGROUND OF THE INVENTION

The invention relates to a tubular electric incandescent lamp provided with:

a tubular translucent lamp vessel which is sealed in a vacuum-tight manner and has a longitudinal axis, a filament longitudinally arranged in the lamp vessel, a respective metal hood arranged in a respective cup-shaped insulator housing secured to the ends of the lamp vessel, current supply conductors extending from the filament to a respective metal hood, contact members which are connected to a respective metal hood and extend through an opening in the respective insulator housing to the exterior transversely with respect to the longitudinal axis of the lamp vessel.

Such a lamp is known from U.S. Pat. No. 2,145,787.

The known lamp has disk-shaped metal hoods which are fused with the tubular lamp vessel. The metal hoods have in their central part a recess. The contact members are each undetachably connected to an insulator housing. They have at a part located within the insulator housing resilient fingers arranged so that they can together engage into the recess of a metal hood. The contact members are then rotatable through an arbitrary angle about the axis of the lamp vessel. A lamp provided at both ends with such a contact member is ready to be arranged with these contact members in the lamp holders of a luminaire intended to be used for this purpose.

The known lamp has the disadvantage that, when the lamp is removed from the luminaire, the connection between a contact member and the lamp vessel can be lost, while the connection between the luminaire and the contact member is maintained. If attemps are then made to remove this contact member from the luminaire, there is a risk that the resilient fingers are touched while they are still at a high voltage.

Since both contact members have to contact a respective lamp holder of a luminaire, the relative distance of these lamp holders should be adapted to the relative distance of the contact members. However, it has been found that the relative distance of the lamp holders can differ so greatly from the relative distance of the contact members of the lamp that the contact members must be given an oblique position respect to the axis of the lamp vessel in order to be able to arrange these contact members in the lamp holders. There may then be a risk that the resilient fingers of the contact members lose their grip on the recess in the metal hood. There may also be a risk that a metal hood of the lamp can be touched while the lamp is situated in the luminaire and is at a high voltage.

The invention has for its object to provide a lamp of a simple construction, whose contact members are undetachably connected to the metal hoods. The invention has more particularly for its object to provide a lamp having a construction which permits of using the lamp in luminaires having different lamp holder distances without another position of the contact members with respect to the longitudinal axis being required.

SUMMARY OF THE INVENTION

According to the invention, this object is achieved in a lamp of the kind mentioned in the opening paragraph in that the metal hoods are hollow bodies having a circumferential wall portion and a base portion, which abut with their open end against the lamp vessel and have a collar near their base portion, the contact members each have a bifurcate part, which surrounds with clamping fit the circumferential wall portion of the respective metal hood at the side of the collar remote from the base portion, and the insulator housings keep the respective contact members locked against radial displacement.

In a particular embodiment, at least one of the contact members is displaceable between two extreme positions in the longitudinal direction of the lamp vessel. Thus, the lamp can be adapted to the relative distance of the lamp holders of a luminaire. This adaptation possibility is larger if both contact members are displaceable in this longitudinal direction. In a preferred embodiment, the contact members are displaceable together with the insulator housings. This embodiment affords the advantage that the contact members need not be touched to displace them.

The circumferential wall portion of the metal hood may be circular-cylindrical, but may alternatively have other cylindrical shapes.

On behalf of the safety and avoidance of touching the lamp, the length of the insulator housing is preferably chosen so that they surround the metal hoods laterally substantially entirely even if these insulator housings are displaceable.

The lamp can be assembled in a very simple manner if the insulator housings comprise a tubular part and a cup-shaped part. The cup-shaped part has a base portion and a circumferential wall portion. The last-mentioned portion can be located with its end remote from the base portion within the tubular part. The parts can be undetachably or permanently connected to each other in various ways, for example, by means of glue or ultrasonic vibrations or by mechanical means, for example by a snap connection with the aid of barbed hooks.

BRIEF DESCRIPTION OF THE DRAWING

Embodiments of the lamp according to the invention are described more fully with reference to the drawing. In the drawing.

DETAILED DESCRIPTION OF THE INVENTION

Figure 1:
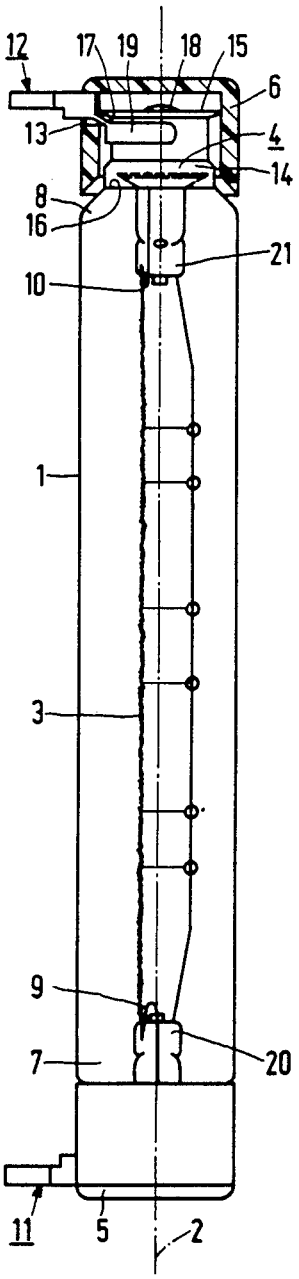
FIG. 1 is a side elevation of a lamp with one insulator housing in a longitudinal sectional view.

In FIG. 1, the lamp has a tubular translucent lamp vessel 1 which is sealed in a vacuum-tight manner and has a longitudinal axis 2, a filament 3 being longitudinally arranged in this lamp vessel 1. A respective metal hood 4, which is arranged in a respective cup-shaped insulator housing 5, 6 of synthetic material, is secured to the ends 7, 8 of the lamp vessel 1. Current supply conductors 9, 10 extend from the filament 3 to a respective metal hood 4. Contact members 11, 12 which are connected to a respective metal hood 4, extend to the exterior through an opening 13 in the respective insulator housing 5, 6 transversely with respect to the longitudinal axis 2 of the lamp vessel 1.

The metal hoods 4 are hollow bodies having a circumferential wall 14 and a base portion 15, which abut with their open end 16 against the lamp vessel 1 and have a collar 17 near the base portion 15. The current supply conductors 9, 10 are secured to the base portion 15 of a respective metal hood 4 by means of solder 18.

Due to the fact that the metal hood 4 is wide at its open end 16 and has a collar 17, its circumferential wall 14 has a wide groove, at the side of the collar 17 which is remote from the base portion 15.

The contact members 11, 12 each have a bifurcate part 19, which surrounds with clamping fit the circumferential wall portion 14 of the respective metal hood 4 at the side of the collar 17 remote from the base portion 15. The insulator housings 5, 6 keep the respective contact members 11, 12 locked against radial displacement due to the fact that they do not offer a sufficient amount of space for such a displacement. In the embodiment shown, the metal hood 4 is circular in cross-section. With the small amount of clearance which the insulator housing 6 allows for the contact member 12 in the radial direction, the contact member 12 cannot be displaced radially over such a large distance that the bifurcate part 19 thereof no longer grips around the metal hood 4 through more than 180°. In case of a forced radial displacement of the contact member 12, this member returns to the starting position under the influence of its own clamping effect after the force leading to this displacement has disappeared.

The embodiment shown also permits of rotating the contact member 12 with the insulator housing 6 about the axis 2, for example, in order to position the filament 3 and the contact member 12 with respect to the axis 2 diametrically opposite to each other.

The Figure illustrates that the contact member 12 is almost in an extreme longitudinal position in which it engages the collar 17. This collar 17 prevents the contact member 12 from being removed from the metal hood 4 in the longitudinal direction of the lamp vessel 1. The metal hood 4 permits the contact member 12 from being displaced in the longitudinal direction towards the tube end 8. The fit of the contact member 12 in the opening 13 of the insulator housing 6 ensures that such a longitudinal displacement is connected with a displacement of the insulator housing 6. Space is available for this displacement of the insulator housing 6. The insulator housing 5 at the end 9 of the lamp vessel 1, at which the lamp has an identical construction, is in the other extreme position together with the contact member 11. The insulator housing 6 still surrounds the metal hood 4 in the extreme position shown. From an electrical point of view, the contact member 12 with the insulator housing 6 can be safely displaced.

By cooperation of the collar 17 and the insulator housing 6, the contact member 12 is undetachably connected to the metal hood 4.

In contrast with the known lamp, the lamp vessel 1 is not closed by the metal hood 4. At its ends 7,8, the lamp vessel 1 is fused with stem tubes 20,21, which close the lamp vessel 1. The metal hoods 4 are fixed on the ends 7,8 by means of cement. Inter alia as a result thereof, the lamp can be manufactured in a very simple manner.

Figure 2:
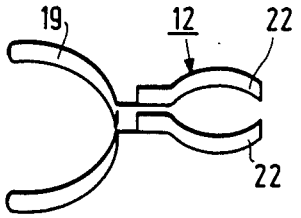
FIG. 2 is a perspective view of a contact member.

FIG. 2, shows tongues 22 of the contact member 12, which have to contact a conductor of the luminaire in order to supply the lamp with current.

Figure 3:
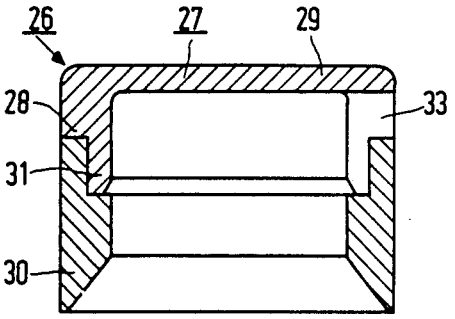
FIG. 3 is a longitudinal sectional view of an insulator housing.

The insulator housing 26 of FIG. 3 has a cup-shaped part 27 with a base portion 29 and a circumferential wall portion 28, as well as a tubular part 30. The wall portion 28 lies with its end 31 remote from the base portion 29 within the tubular part 30. The cup-shaped part 27 has an opening 33, through which a contact member can project to the exterior. The two parts 29, 30 of the insulator housing 26 are undetachably or permanently connected to each other, for example by ultrasonic vibrations or by means of an adhesive. In the manufacture of the lamp, the tubular part 30 is arranged to surround an end 8 of the lamp vessel 1 (FIG. 1). Subsequently, the contact member 12 is positioned, whereupon the cup-shaped part 27 is mounted.

Figure 4:
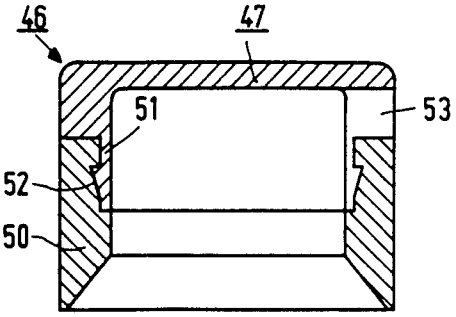
FIG. 4 is a longitudinal sectional view of another embodiment of an insulator housing.

FIG. 4, in which parts corresponding to those in FIG. 3 are denoted by reference numerals which are 20 higher, shows an insulator housing 46 of which the parts 47 and 50 are mechanically coupled to each other. In the Figure, the coupling is obtained by a snap connection 52 of one or more grooves and one or more cams.

What is claimed is:

1. A tubular electric incandescent lamp comprising:
- a tubular translucent lamp vessel which is sealed in a vacuum-tight manner and has a longitudinal axis,
- a filament longitudinally arranged in the lamp vessel,
- a respective metal hood arranged in a respective cup-shaped insulator housing secured to the ends of the lamp vessel,
- current supply conductors extending from the filament to a respective metal hood, and
- contact members which are connected to a respective metal hood and extend through an opening in the respective insulator housing to the exterior transversely with respect to the longitudinal axis of the lamp vessel,
- characterized in that the metal hoods are hollow bodies having a circumferential wall and a base portion and an open end opposite the base portion, which abut with their open end against the vessel and have a collar near their base portion,
- the contact members each have a bifurcate part, which surrounds with clamping fit the circumferential wall portion of the respective metal hood at the side of the collar remote from the base portion, and
- the insulator housings keep the respective contact members locked against radial displacement.

2. A tubular incandescent lamp as claimed in claim 1, characterized in that at least one contact member is displaceable in the longitudinal direction of the lamp vessel.

3. A tubular incandescent lamp as claimed in claim 1, characterized in that both contact members are displaceable in the longitudinal direction of the lamp vessel.

4. A tubular incandescent lamp as claimed in claim 1, characterized in that at least one contact member is displaceable in the longitudinal direction together with the respective insulator housing.

5. A tubular incandescent lamp as claimed in claim 1, characterized in that both contact members are displaceable in the longitudinal direction together with the respective insulator housing.

6. A tubular incandescent lamp as claimed in claim 1 or 2, characterized in that the insulator housings surround at least substantially the entire respective metal hood.

7. A tubular incandescent lamp as claimed in claim 1, 2, or 4, characterized in that the insulator housings comprise a tubular part and a cup-shaped part, which are permanently connected to each other.

8. A tubular incandescent lamp as claimed in claim 1, 2, or 4, characterized in that the insulator housings each comprise a tubular part and a cup-shaped part having a base portion and a circumferential wall portion terminating at an end remote from the base portion, the end of the circumferential wall portion remote from the base portion being located within the tubular part with the tubular part surrounding substantially the entire respective metal hood.

9. A tubular incandescent lamp as claimed in claim 1, 2, or 4, characterized in that the insulator housings comprise a tubular part and a cup-shaped part having a base portion and a circumferential wall portion terminating at an end remote from the base portion, the end of the circumferential wall portion remote from the base portion being located within the tubular part with the tubular part surrounding substantially the entire respective metal hood, and the tubular part and the cup-shaped part being mechanically coupled to each other.

10. A tubular incandescent lamp as claimed in claim 6, characterized in that the insulator housings each comprise a tubular part and a cup-shaped part, which are permanently connected to each other.

11. A tubular incandescent lamp as claimed in claim 6, characterized in that the insulator housings comprise a tubular part and a cup-shaped part having a base portion and a circumferential wall portion terminating at an end remote from the base portion, the end of the circumferential wall portion remote from the base portion being located within the tubular part with the tubular part surrounding substantially the entire respective metal hood.

12. A tubular incandescent lamp as claimed in claim 6, characterized in that the insulator housings each comprise a tubular part and a cup-shaped part having a base portion and a circumferential wall portion terminating at an end remote from the base portion, the end of the circumferential wall portion remote from the base portion being located within the tubular part with the tubular part surrounding substantially the entire respective metal hood, and the tubular part and the cup-shaped part being mechanically coupled to each other.

* * * * *